US007466945B2

(12) United States Patent
Hattori

(10) Patent No.: US 7,466,945 B2
(45) Date of Patent: Dec. 16, 2008

(54) TONER CONTAINER, TONER REPLENISHING DEVICE, DEVELOPING DEVICE, PROCESS CARTRIDGE AND IMAGE FORMING APPARATUS

(75) Inventor: Yoshio Hattori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 252 days.

(21) Appl. No.: 11/069,994

(22) Filed: Mar. 3, 2005

(65) Prior Publication Data

US 2005/0196199 A1 Sep. 8, 2005

(30) Foreign Application Priority Data

Mar. 5, 2004 (JP) ..... 2004-062244
Sep. 22, 2004 (JP) ..... 2004-274640

(51) Int. Cl.
*G03G 15/08* (2006.01)

(52) U.S. Cl. ..... 399/262

(58) Field of Classification Search ..... 399/103–106, 399/262; 222/DIG. 1
See application file for complete search history.

(56) References Cited

U.S. PATENT DOCUMENTS 4,878,603 A 11/1989 Ikesue et al.
5,441,177 A 8/1995 Yanagisawa
5,455,662 A 10/1995 Ichikawa et al.
5,557,382 A 9/1996 Tatsumi et al.
5,648,840 A 7/1997 Ikunami et al.
5,659,860 A 8/1997 Sasaki et al.
5,722,014 A 2/1998 Fike
5,722,019 A 2/1998 Nakajima
5,754,916 A 5/1998 Kitayama et al.
5,758,235 A 5/1998 Kosuge et al.
5,765,059 A 6/1998 Kosuge et al.
5,765,079 A 6/1998 Yoshiki et al.
5,768,664 A 6/1998 Kosuge et al.
5,774,773 A 6/1998 Otsuka et al.
5,794,108 A 8/1998 Yoshizawa et al.
5,828,935 A 10/1998 Tatsumi et al.
5,890,040 A 3/1999 Matsuoka et al.
5,909,610 A 6/1999 Yoshiki et al.
5,913,097 A 6/1999 Nakano et al.
5,915,155 A 6/1999 Shoji et al.
5,966,574 A 10/1999 Ui et al.

(Continued)

FOREIGN PATENT DOCUMENTS

EP 0 435 596 7/1991

(Continued)

OTHER PUBLICATIONS

Patent Abstracts of Japan, JP 09-197783, Jul. 31, 1997.

(Continued)

*Primary Examiner*—Ryan Gleitz
(74) *Attorney, Agent, or Firm*—Oblon, Spivak, McClelland, Maier & Neustadt, P.C.

(57) ABSTRACT

A toner container of the present invention stores toner and includes a cylindrical portion. A raised portion rises above the circumferential surface of the raised portion and formed with a toner outlet open obliquely to the circumferential surface. A shutter is mounted on the circumferential surface of the cylindrical portion and movable along the above surface to selectively open or close the toner outlet.

22 Claims, 7 Drawing Sheets

U.S. PATENT DOCUMENTS

| | | | | |
|---|---|---|---|---|
| 5,970,290 | A | 10/1999 | Yoshiki et al. | |
| 6,104,900 | A | 8/2000 | Ishikawa et al. | |
| 6,118,951 | A | 9/2000 | Kato et al. | |
| 6,125,243 | A | 9/2000 | Shoji et al. | |
| 6,141,520 | A | 10/2000 | Kosuge | |
| 6,163,666 | A | 12/2000 | Hosokawa et al. | |
| 6,185,401 | B1 * | 2/2001 | Kanamori et al. | 399/262 |
| 6,198,895 | B1 | 3/2001 | Tsuda et al. | |
| 6,212,343 | B1 | 4/2001 | Hosokawa et al. | |
| 6,256,469 | B1 | 7/2001 | Tanayama et al. | |
| 6,266,501 | B1 | 7/2001 | Mizuishi et al. | |
| 6,289,195 | B1 | 9/2001 | Ichikawa et al. | |
| 6,336,020 | B1 | 1/2002 | Ishikawa et al. | |
| 6,337,957 | B1 | 1/2002 | Tamaki et al. | |
| 6,363,237 | B1 | 3/2002 | Nagame et al. | |
| 6,366,755 | B1 | 4/2002 | Takashima | |
| 6,393,241 | B1 | 5/2002 | Matsumoto et al. | |
| 6,447,973 | B1 | 9/2002 | Asami et al. | |
| 6,493,529 | B1 | 12/2002 | Umemura et al. | |
| 6,501,913 | B2 | 12/2002 | Hattori et al. | |
| 6,507,720 | B2 | 1/2003 | Kabumoto et al. | |
| 6,521,386 | B1 | 2/2003 | Sakon et al. | |
| 6,522,855 | B1 | 2/2003 | Katoh et al. | |
| 6,558,862 | B2 | 5/2003 | Kojima et al. | |
| 6,560,431 | B2 | 5/2003 | Hosokawa | |
| 6,562,529 | B1 | 5/2003 | Kojima et al. | |
| 6,567,637 | B2 | 5/2003 | Yanagisawa et al. | |
| 6,591,077 | B2 | 7/2003 | Yanagisawa et al. | |
| 6,615,013 | B2 | 9/2003 | Arai et al. | |
| 6,628,908 | B2 | 9/2003 | Matsumoto et al. | |
| 6,665,508 | B2 | 12/2003 | Sudo et al. | |
| 6,775,503 | B2 | 8/2004 | Hattori et al. | |
| 6,826,381 | B2 | 11/2004 | Muramatsu et al. | |
| 6,898,407 | B2 | 5/2005 | Noguchi et al. | |
| 6,937,838 | B2 | 8/2005 | Ishii et al. | |
| 7,043,173 | B2 | 5/2006 | Grune et al. | |
| 7,313,349 | B2 | 12/2007 | Suzuki et al. | |
| 7,321,744 | B2 | 1/2008 | Hosokawa et al. | |
| 2002/0102112 | A1 | 8/2002 | Hung-Hsu | |
| 2002/0102113 | A1 | 8/2002 | Kusano et al. | |
| 2003/0116923 | A1 | 6/2003 | Meetze et al. | |
| 2003/0117892 | A1 | 6/2003 | Litwiller | |
| 2003/0156861 | A1 | 8/2003 | Nagano et al. | |
| 2004/0009015 | A1 | 1/2004 | Fujimori et al. | |
| 2004/0096239 | A1 | 5/2004 | Hosokawa et al. | |
| 2004/0126150 | A1 | 7/2004 | Noguchi et al. | |
| 2004/0131381 | A1 | 7/2004 | Kawasumi et al. | |
| 2004/0165913 | A1 | 8/2004 | Hattori | |
| 2004/0170446 | A1 | 9/2004 | Nagashima et al. | |
| 2004/0170447 | A1 | 9/2004 | Arai et al. | |
| 2004/0184841 | A1 | 9/2004 | Tsuda et al. | |
| 2004/0208676 | A1 | 10/2004 | Ishii et al. | |
| 2004/0223790 | A1 | 11/2004 | Hosokawa et al. | |
| 2004/0240908 | A1 * | 12/2004 | Deguchi et al. | 399/262 |
| 2004/0258432 | A1 | 12/2004 | Hattori et al. | |
| 2004/0265011 | A1 | 12/2004 | Tsuda et al. | |
| 2005/0008393 | A1 | 1/2005 | Kuma et al. | |
| 2005/0008398 | A1 | 1/2005 | Hattori | |
| 2005/0036810 | A1 | 2/2005 | Murakami et al. | |
| 2005/0084293 | A1 | 4/2005 | Fukuchi et al. | |
| 2005/0158071 | A1 | 7/2005 | Hosokawa et al. | |
| 2005/0169653 | A1 | 8/2005 | Noguchi et al. | |
| 2005/0196199 | A1 | 9/2005 | Hattori | |
| 2005/0226656 | A1 | 10/2005 | Tsuda et al. | |
| 2006/0034642 | A1 | 2/2006 | Taguchi et al. | |
| 2007/0077100 | A1 | 4/2007 | Suzuki et al. | |

FOREIGN PATENT DOCUMENTS

| | | |
|---|---|---|
| EP | 0 616 268 | 9/1994 |
| EP | 0 779 561 | 6/1997 |
| EP | 0 801 337 | 10/1997 |
| EP | 1 022 620 | 7/2000 |
| EP | 1 120 691 | 8/2001 |
| EP | 1 220 051 | 7/2002 |
| JP | 60-146265 | 8/1985 |
| JP | 04-000477 | 1/1992 |
| JP | 04-123074 | 4/1992 |
| JP | 6-59576 | 3/1994 |
| JP | 06-110331 | 4/1994 |
| JP | 06-266227 | 9/1994 |
| JP | 07-20705 | 1/1995 |
| JP | 07-043999 | 2/1995 |
| JP | 08-137176 | 5/1996 |
| JP | 09-90727 | 4/1997 |
| JP | 09-160364 | 6/1997 |
| JP | 09-251240 | 9/1997 |
| JP | 09-311535 | 12/1997 |
| JP | 10-63084 | 3/1998 |
| JP | 10-142913 | 5/1998 |
| JP | 11-184232 | 7/1999 |
| JP | 2000-105494 | 4/2000 |
| JP | 2000-172058 | 6/2000 |
| JP | 2000-172059 | 6/2000 |
| JP | 2000187378 A * | 7/2000 |
| JP | 2000-221766 | 8/2000 |
| JP | 2000-275941 | 10/2000 |
| JP | 3120723 | 10/2000 |
| JP | 2000-310901 | 11/2000 |
| JP | 2000-338758 | 12/2000 |
| JP | 2001-5286 | 1/2001 |
| JP | 2001-27839 | 1/2001 |
| JP | 2001-125359 | 5/2001 |
| JP | 2001-265102 | 9/2001 |
| JP | 2002-6601 | 1/2002 |
| JP | 2002-139905 | 5/2002 |
| JP | 2002-169365 | 6/2002 |
| JP | 2002-221858 | 8/2002 |
| JP | 2002-244359 | 8/2002 |
| JP | 2002-268357 | 8/2002 |
| JP | 2002-268295 | 9/2002 |
| JP | 2002-276466 | 9/2002 |
| JP | 2002-357945 | 12/2002 |
| JP | 3384914 | 12/2002 |
| JP | 2004-139031 | 5/2004 |
| WO | WO 2004/077170 | 9/2004 |
| WO | WO 2005/076089 | 8/2005 |

OTHER PUBLICATIONS

Patent Abstracts of Japan, JP 11-202606, Jul. 30, 1999.
Patent Abstracts of Japan, JP 11-288157, Oct. 19, 1999.
Patent Abstracts of Japan, JP 2000-214669, Aug. 4, 2000.

* cited by examiner

TONER CONTAINER, TONER REPLENISHING DEVICE, DEVELOPING DEVICE, PROCESS CARTRIDGE AND IMAGE FORMING APPARATUS

BACKGROUND OF THE INVENTION

1. Field of the Invention

The present invention relates to a toner container for use with a copier, printer, facsimile apparatus, multifunction machine or similar image forming apparatus, a toner replenishing device using the same, a developing device, a process cartridge and an image forming apparatus.

2. Description of the Background Art

It is a common practice with a copier or similar image forming apparatus to use a toner container implemented as a bottle and removably mounted to the apparatus body. Toner stored in the toner container is consumed little by little by repeated development, which forms part or an image forming process. When the toner container substantially runs out of toner, it is suitably replaced with a new toner bottle by the user.

Japanese Patent Laid-Open Publication No. 6-59576, for example, discloses a bottle-like toner container generally made up of a major portion or bottle body and a cylindrical portion or cap contiguous with the front end of the major portion. A toner outlet is formed in part of the cylindrical portion so as to feed toner stored in the toner container.

More specifically, a shutter or shutter member usually closes the toner outlet of the cylindrical portion and is movable along the periphery of cylindrical portion. When the toner container is mounted to a toner replenishing device or toner hopper included in the body of an image forming apparatus, the cylindrical portion of the toner container is brought into engagement with a mount portion included in the toner replenishing device. Subsequently, when a knob included in the mount portion is turned in the circumferential direction, the shutter is moved to open the toner outlet. As a result, toner is replenished from the toner container to the toner replenishing device via the toner outlet.

A seal member is adhered between the toner outlet and shutter of the cylindrical portion in order to prevent the toner from flying about out of the toner container before the toner container is mounted to the apparatus body.

With the prior art toner container described above, it is extremely difficult to enhance both of sealability of the toner outlet and easy operation for opening the toner outlet.

More specifically, it is a common practice with a toner container to adhere a seal member formed of, e.g., foam polyurethane or rubber between the toner outlet and the shutter of the cylindrical portion in order to surely seal the toner outlet. The seal member seals the portion around the toner outlet, which is open on the circumferential wall of the cylindrical portion, in cooperation with the shutter when the shutter is closed. Therefore, the toner outlet can be more surely sealed if the compression ratio of the seal member, for example, is made greater. Also, sealability can be increased if use is made of a material having high adhesion.

On the other hand, if the seal pressure or adhesion of the seal member is high, then it is difficult to open or close the shutter when the toner container is mounted to or dismounted from the apparatus body. More specifically, when the toner outlet is opened or closed, the shutter slides on the circumferential surface of the cylindrical portion with the seal surface of the seal member sliding on the circumferential surface. It follows that the higher the seal pressure or the adhesion of the seal surface of the seal member, the greater the frictional force to act when the shutter is slid, i.e., the lower the operability. Moreover, if the seal pressure or adhesion of the seal member is excessively high, then the frictional force acting against the slide of the shutter overcomes, e.g., the shearing strength of the seal member and causes the seal member to come off.

SUMMARY OF THE INVENTION

It is an object of the present invention to provide a toner container, a toner replenishing device, a developing device, a process cartridge and an image forming apparatus capable of insuring sealability around a toner outlet while promoting easy operation in the event of opening and closing of the toner outlet.

A toner container for storing toner of the present invention includes a cylindrical portion including a raised portion rising above the circumferential surface of the cylindrical portion. The raised portion is formed with a toner outlet open obliquely to the circumferential surface of the cylindrical portion. A shutter is movable along the circumferential surface of the cylindrical portion to selectively open or close the toner outlet.

Also, a toner container for storing toner of the present invention includes a cylindrical portion including a raised portion rising above the circumferential surface of the cylindrical surface and formed with a toner outlet. A shutter is movable along the circumferential surface of the cylindrical portion for selectively opening or closing the toner outlet. The shutter is provided with a seal member for sealing the toner outlet and neighborhood thereof. The seal member is so positioned as not to slide relative to the toner outlet or neighborhood thereof when the shutter moves.

BRIEF DESCRIPTION OF THE DRAWINGS

The above and other objects, features and advantages of the present invention will become more apparent from the following detailed description taken with the accompanying drawings in which.

In the figures, identical structural elements are designated by identical reference numerals, and a detailed description thereof will not be made in order to avoid redundancy.

DESCRIPTION OF THE PREFERRED EMBODIMENTS

Figure 1:
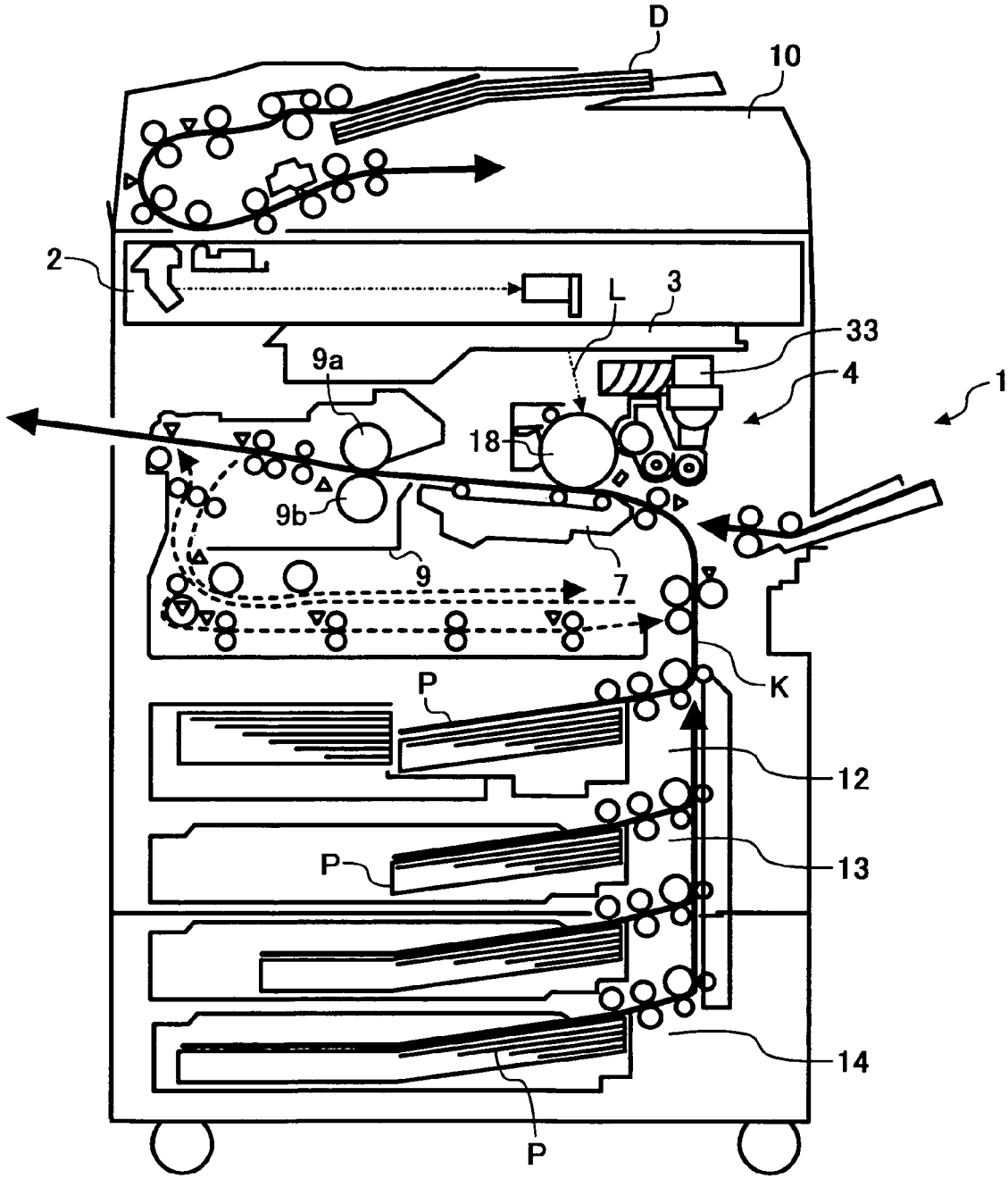
FIG. 1 is a view showing the general construction of an image forming apparatus embodying the present invention.

Referring to FIG. 1 of the drawings, an image forming apparatus embodying the present invention is shown an implemented as a copier by way of example. As shown, the copier includes a copier body 1. An image scanning section 2 optically scans a document D to read image data. An exposing section 3 scans the surface of a photoconductive drum 18 with a light beam L modulated in accordance with the image data read by the image scanning section 2. A process cartridge 4 plays the role of an image forming section for forming a toner image on the drum 18. An image transferring section 7 is configured to transfer the toner image formed on the drum 18 to a sheet or recording medium P. A fixing section 9 fixes the toner image transferred to the sheet P with a heat roller 9*a* and a press roller 9*b*. An ADF (Automatic Document Feeder) 10 sequentially conveys documents D stacked thereon to the document scanning section 2 one by one. Sheet cassettes 12, 13 and 14 each are loaded with a stack of sheets P. The reference numeral 33 designates a toner bottle, which is a specific form of a toner container.

The usual image forming operation of the copier having the above construction will be described hereinafter. First, the ADF 10 conveys a document from document tray toward the image scanning section 2 in a direction indicated by an arrow in FIG. 1. While the document is being conveyed above the document scanning section 2, the scanning section 2 optically reads the image of the document. Optical image data thus read are converted to an electric signal and sent to the exposing section or writing section 3. The exposing section 3 scans the surface of the drum 18, which is included in the process cartridge 4, with a laser beam or similar light beam L in accordance with the image signal.

On the other hand, in the process cartridge 4, the drum 18 is rotating clockwise, as viewed in FIG. 1, so that a toner image is formed on the drum 18 in accordance with the image data via a preselected image forming step including a charging step, an exposing step and a developing step. The toner image is then transferred from the drum 18 to a sheet P conveyed by a registration roller pair by the image transferring section 7.

More specifically, any one of the sheet cassettes 12 through 14 is selected either automatically or manually. Assume that the top sheet cassette 12 is selected by way of example. Then, the top sheet P is paid out from the top sheet cassette 12 toward a sheet path K while being separated from the other sheets underlying it. The sheet P is conveyed along the sheet path K to the registration roller pair and then conveyed by the registration roller pair toward the image transferring section in synchronism with the rotation of the drum 18.

The sheet P, carrying the toner image transferred from the drum 18 at the image transferring section 7, is conveyed to the fixing section 9. The fixing section 9 fixes the toner image on the sheet P with the heat of the heat roller 9*a* and the pressure of the pressure roller 9*b* while conveying it. The sheet P, coming out of the fixing section 9, is driven out of the copier as a copy. This is the end of an image forming process.

Figure 2:
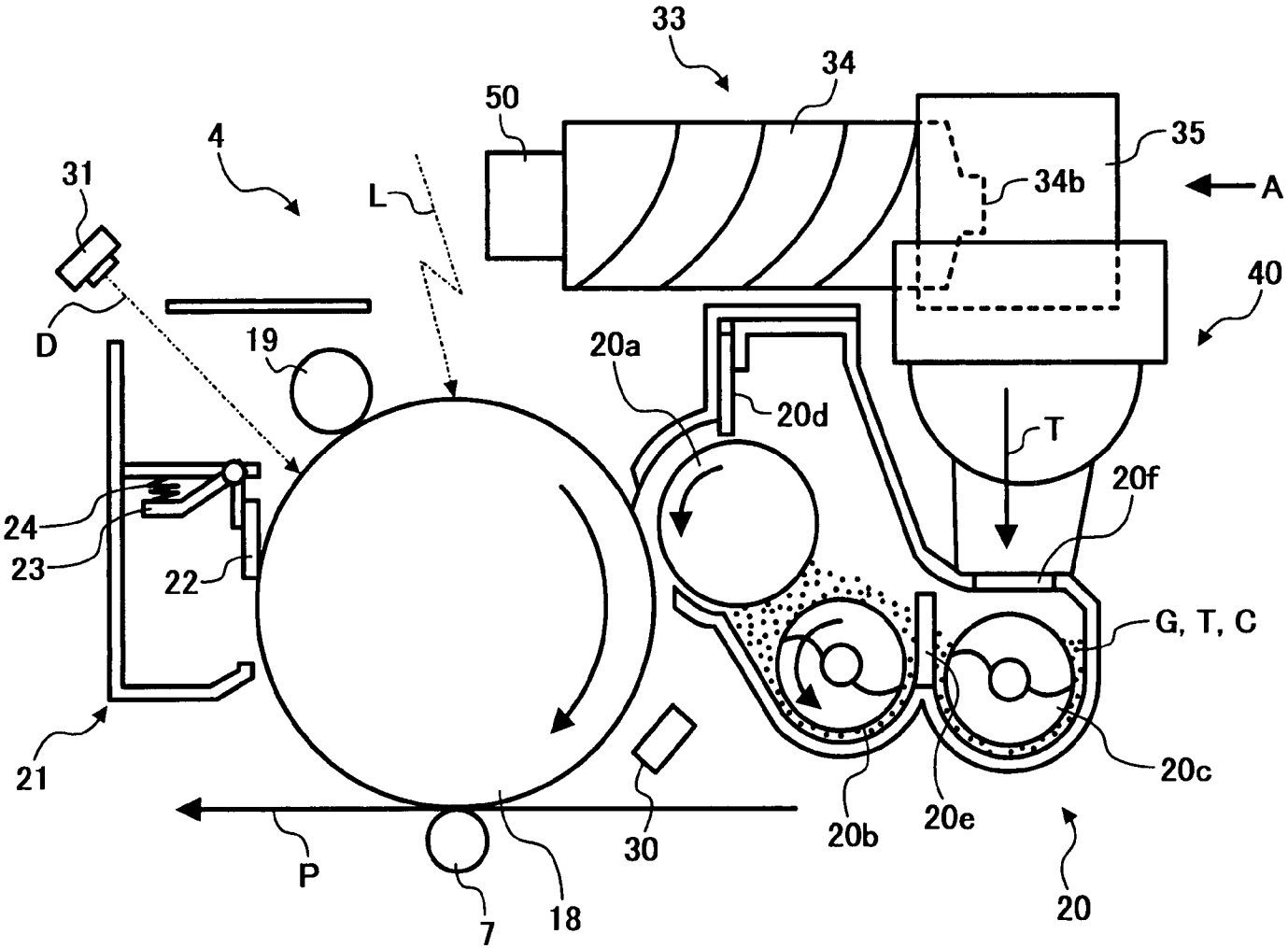
FIG. 2 is a section showing a toner container included in the illustrative embodiment and arrangements around it.

The toner bottle 33 removably mounted to the copier body 1 will be described with reference to FIGS. 2 through 5 specifically. As shown in FIG. 2, the toner bottle 33 is positioned on a toner replenishing device 40 arranged on the copier body 1. In such a position, the bottom of the bottle 33 is engaged with a driving device 50 included in the copier body 1.

Figure 3:
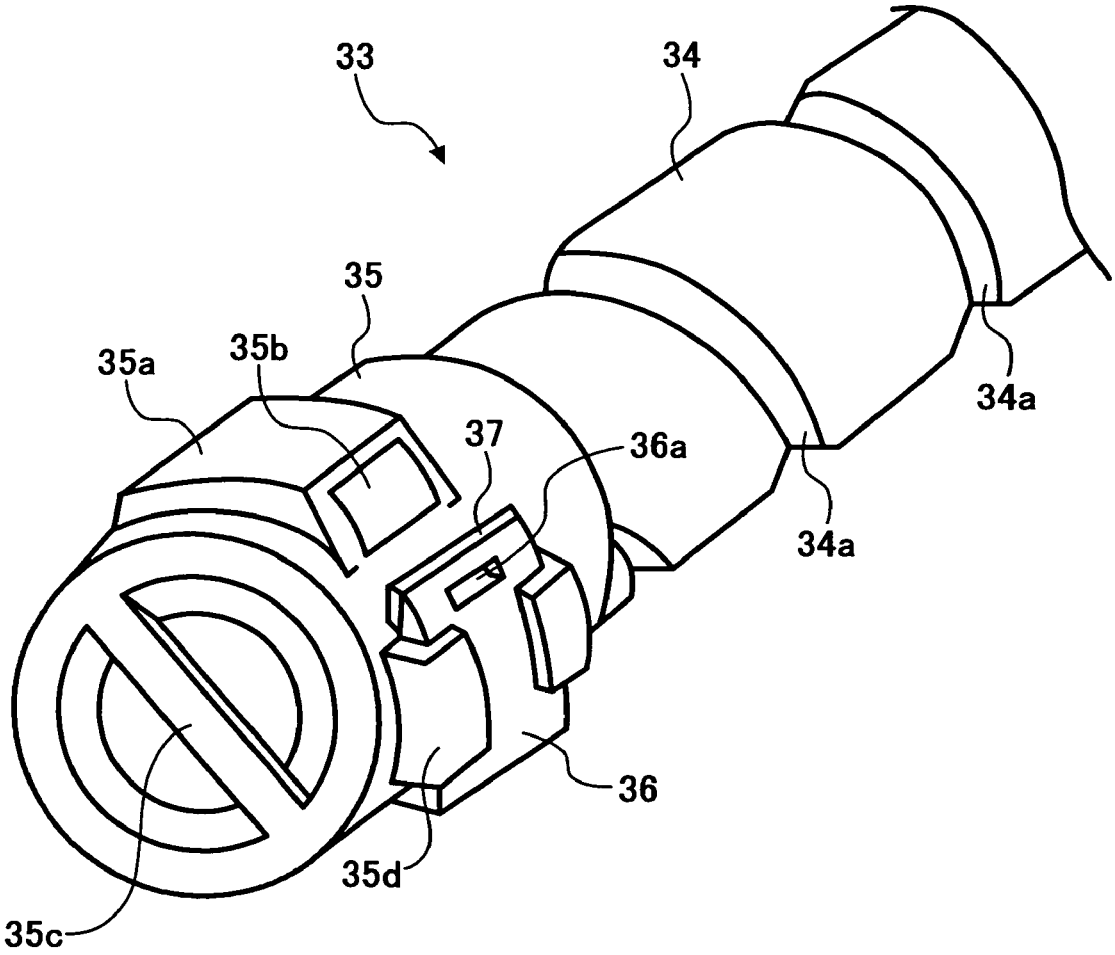
FIG. 3 is a fragmentary isometric view of the toner container.

As shown in FIG. 3, the toner bottle 33 is made up of a bottle body or major portion 34 storing toner and a bottle cap or cylindrical portion 35. A spiral ridge 34*a* is formed on the inner circumferential surface of the bottle body 34. A toner outlet 34*b* is formed in the bottle body 34 and received in the bottle cap 35, as shown in FIG. 2. A drive transmitting portion, not shown, is formed on the bottom of the bottle body 34 opposite to the side where the toner outlet 34*b* is positioned, and is so configured as to mate with a drive portion 50 included in the copier body 1.

In operation, the bottle body 34 is caused to rotate by the drive portion 50, but the bottle cap 35 is fixed in place and unmovable. As a result, the toner in the bottle body 34 is conveyed toward the toner outlet 34*b* by the annular ridge 34*a* and then drops into the bottle cap 35 via the toner outlet 34*b*.

Figure 4:
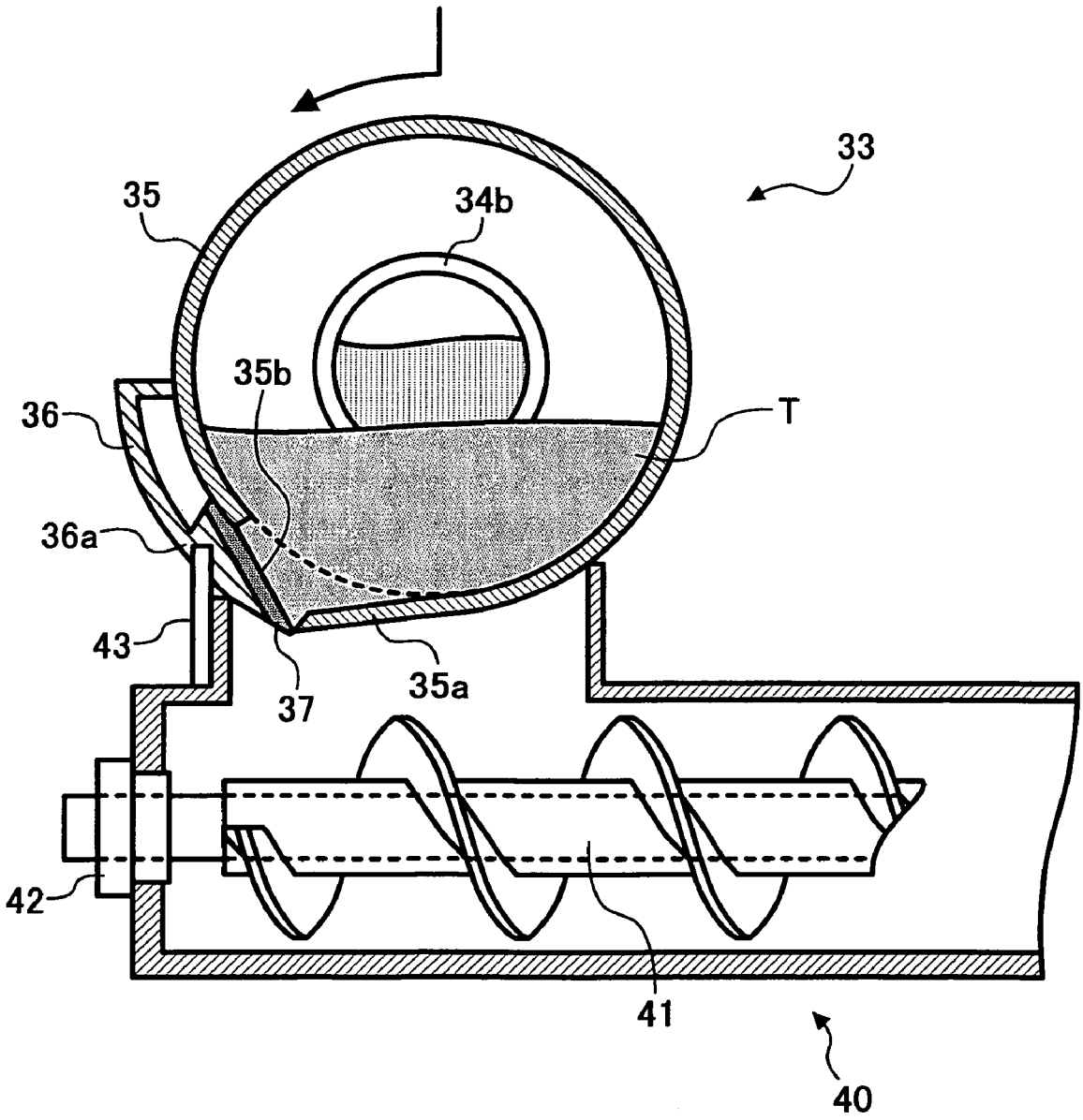
FIG. 4 is a section showing the toner container with a toner outlet being closed.
Figure 5:
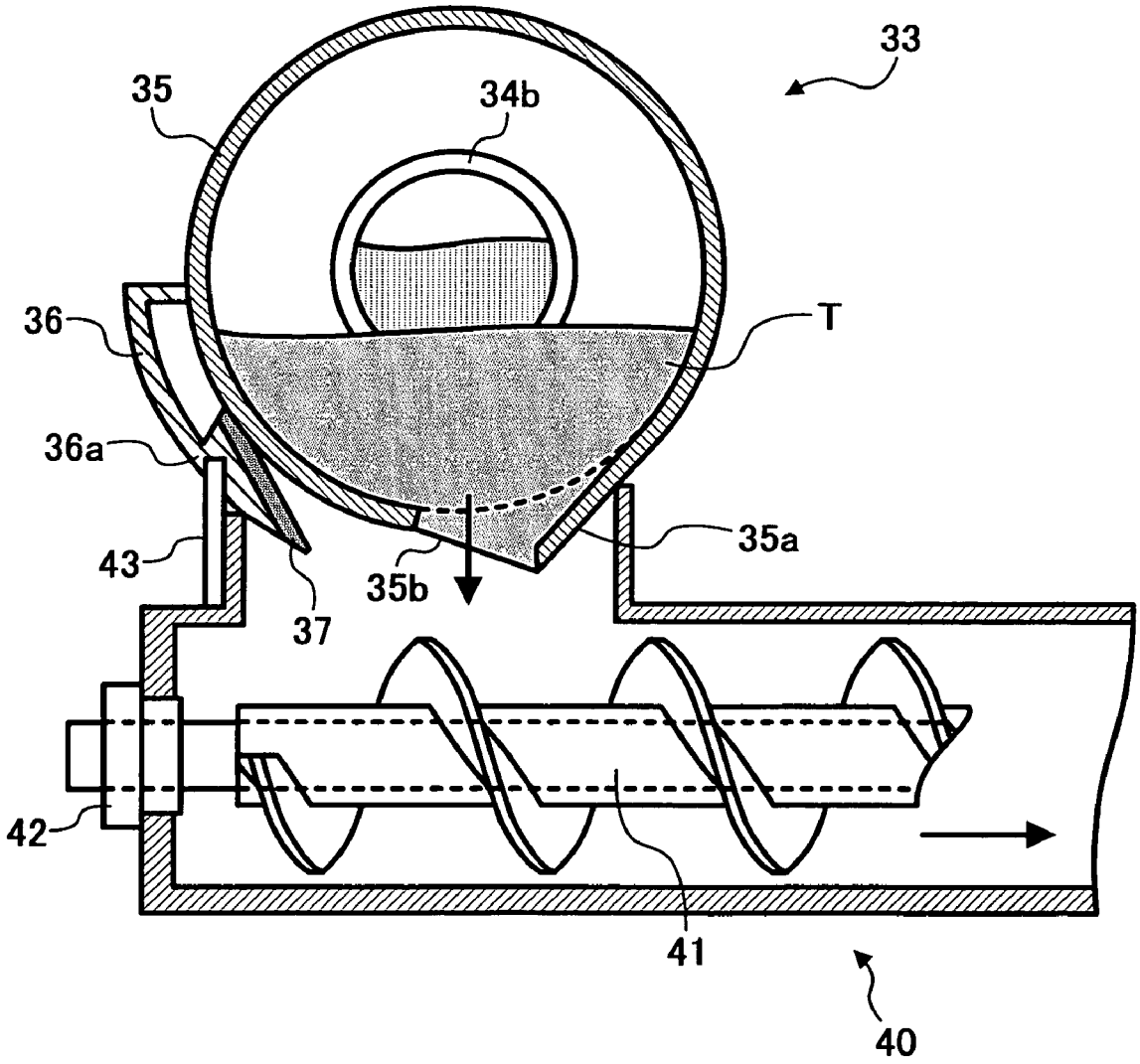
FIG. 5 is a section showing the toner container with the toner outlet being opened.

As shown in FIG. 3, the bottle cap 35 includes a raised portion 35*a*, a toner outlet 35*b*, a thumb piece 35*c* and a shutter 36. As shown in FIGS. 3 through 5, the raised portion 35*a* rises above the circumferential surface of the bottle cap 35 in the form of a projection. The toner outlet 35*b* is formed in the raised portion 35*a*. The toner outlet 35*b* is inclined relative to the circumferential surface of the bottle cap 35 such that when the raised portion 35*a* faces downward, the toner in the bottle cap 35 drops via the toner outlet 35*b* due to its own weight.

The shutter 36 is supported by a support portion 35*d* formed on the circumferential surface of the bottle cap 35 in such a manner as to be movable along the above surface. The end face of the shutter 36 that faces the toner outlet 35*b*, i.e., the engaging face of the shutter 36 is inclined relative to the circumferential surface of the bottle cap 35 and capable of closing the toner outlet 35*b*. More specifically, the shutter 36 slides on the circumferential surface of the bottle cap 35 to selectively open or close the toner outlet 35*b*. In this manner, the engaging surface of the shutter 36 and the outer periphery of the bottle cap 35 do not face each other.

A seal member 37 is adhered to the engaging surface of the shutter 36 and may be formed of polyurethane rubber or similar rubber by way of example. When the shutter 36 closes the toner outlet 35*b*, the seal member 37 intervenes between the shutter 36 and the toner outlet 35*b* to thereby prevent the toner from flying about.

It is noteworthy that the seal member 37, adhered to part of the shutter 36 not facing the periphery of the bottle cap 35, is not rubbed against the bottle cap 36 even when he shutter 36 is moved in the circumferential direction. Stated another way, the operability of the shutter 36 in the circumferential direction and the sealability of the seal member 37 can be split in function from each other. It is therefore possible to improve the sealability of the seal member 37 without degrading the operability of the shutter 36.

While the seal member 37 is adhered to the engaging surface of the shutter 36 in the illustrative embodiment, it may alternatively be fitted on the bottle cap 35 around the toner outlet 35*b* or on each of the shutter 36 and bottle cap 35.

A hole 36*a* is formed in the circumferential wall of the shutter 36. The hole 36*a* is configured to mate with a catch member 43 included in the toner replenishing device 40 when the toner bottle 33 is mounted to the toner replenishing section 40, so that the shutter 36 of the toner bottle 33 can be opened and closed on the toner replenishing device 40.

As shown in FIG. 3, the thumb piece 35*c* is formed on the end face of the bottle cap 35 opposite to the bottle body 34. The user of the copier is expected to nip the thumb piece 35*c* when mounting the toner bottle 33 to the toner replenishing device 40. How the toner bottle 33 is mounted to the toner replenishing device 40 will be described specifically later.

As shown in FIGS. 4 and 5, which are views as seen in a direction A shown in FIG. 2, the toner replenishing device 40 includes a screw 41 rotatably supported by bearings 42 (only on is shown) at opposite ends, the catch member 43 engageable with the hole 36*a* of the toner bottle 33, and so forth. The screw 41 is caused to rotate by a drive motor no shown. In this condition, toner T fed from the toner bottle 33 to the toner replenishing device 40 is conveyed by the screw 41 to the right, as viewed in FIGS. 4 and 5, and then replenished to a developing section 20 via a hole, not shown, which is communicated to an inlet port 20*f* formed in the developing section 20.

As shown in FIG. 2, the process cartridge 4 is a unit removably mounted to the copier body 1 and including the drum or image carrier 18, a charger or charging means, the developing section or developing means 20 and a cleaning section or cleaning means 21. The toner T is suitably replenished from the toner replenishing device 40 to the developing section 20.

The drum 18 consists of an aluminum pipe and various layers sequentially formed thereon and including a charge generation layer and a charge transport layer. In the illustrative embodiment, the charger 19 is implemented as a charge roller consisting of a stainless steel rod and a conductive roller portion in which conductive powder is dispersed in resin.

The developing section 20 includes a developing roller 20*a* facing the drum 18, a first screw 20*b* facing the developing roller 20*a*, a second screw 20*c* facing the first screw 20*b* via a partition member 20*e*, and a doctor blade 20*d* facing the developing roller 20*a*. The developing section 20 stores a two-ingredient type developer G consisting of the toner T and a carrier CF.

The cleaning section 21 includes a cleaning blade 22 formed of, e.g., urethane rubber or similar rubber and held in contact with the surface of the drum 18 in a direction counter to the direction of rotation of the drum 18. More specifically, a spring 24 constantly biases a support plate 23, which supports the cleaning blade, 22 against the drum 18 by a preselected pressure.

An image forming process to be executed on the drum 18 of the process cartridge 4 will be described in detail hereinafter. The drum 18 is caused to rotate clockwise, as viewed in FIG. 2, by the drive motor not shown. The charger 19 uniformly charges the surface of the drum 18 to a preselected potential at a position where the drum 18 faces the charger 19 (charging step).

Subsequently, the light beam L, modulated in accordance with image data, scans the charged surface of the drum 18 image wise in the main scanning direction, which is perpendicular to the sheet surface of FIG. 2, thereby forming a latent image on the drum 18. When the surface of the drum 18, carrying the latent image thereon, is brought to the developing section 20, the developing section 20 develops the latent image with the toner to thereby produce a corresponding toner image.

More specifically, in the developing section 20, the developing roller 20*a* is rotating in a direction indicated by an arrow in FIG. 2. The developer G present in the developing section 20 is circulated by the first and second screws 20*b* and 20*c* in the lengthwise direction, which is perpendicular to the sheet surface of FIG. 2, while being agitated and mixed with the fresh toner T replenished from the toner replenishing device 40. The toner grains T thus deposited on the carrier grains C by frictional charge are then deposited on the developing roller 20*a* together with the carrier grains C. The developer G deposited on the developing roller 20*a* is metered by the doctor blade 20*d* and then brought to a developing zone where the developing roller 20*a* faces the drum 18. At the developing zone, the toner grains contained in the developer G are transferred to the latent image carried on the drum 18, producing a corresponding toner image.

The toner replenishing device 40 included in the copier body 1 suitably replenishes the fresh toner T via the inlet port 20*f* in accordance with the consumption of the toner T present in the developing section 20. A photosensor 30 is positioned to face the drum 18 in order to indirectly sense the consumption of the toner T.

Subsequently, the surface of the drum 18, carrying the toner image thereon, faces the image transferring section 7 via the photosensor 30. The image transferring section 7 transfers the toner image from the drum 18 to the sheet P conveyed to the section 7. However, the toner T is left on the drum 18, although in a small amount, without being transferred to the sheet P. Such residual toner T is removed by the cleaning blade 22, whereby the surface of the drum 18 is cleaned. The toner T thus removed from the drum 18 is collected in a space available in the cleaning section 21.

Thereafter, a discharger 31 discharges the cleaned surface of the drum 18 with light D for thereby preparing the drum 18 for the next image forming operation. This is the end of a sequence of image forming steps.

How the toner bottle 33 is mounted to the copier body 1 will be described hereinafter with reference to FIGS. 4 and 5. When a cover, not shown, mounted on the copier body 1 is opened by hand, the toner replenishing device 40 is exposed to the outside. Subsequently, the toner bottle 33 with its toner outlet 35*b* hermetically sealed is positioned sideways and then lowered onto the toner replenishing device 40 such that the catch member 43 of the toner replenishing device 40 catches the hole 36*a* of the shutter 36, as shown in FIG. 4.

After the mounting of the toner bottle 33 to the toner replenishing device 40, the bottle cap 35 is turned in a direction indicated by an arrow in FIG. 4 with the thumb piece 35*c* nipped by fingers. At this instant, the shutter 36 mounted on the bottle cap 35 is stopped by the catch member or second engaging member 43 with the result that the toner outlet 35*b* is opened due to the rotation of the bottle cap 35, as illustrated in FIG. 5. That is, the shutter 36 moves on and relative to the circumferential surface of the bottle cap 35 to thereby open the toner outlet 35*b*. By such a procedure, the toner bottle 33 is fully mounted to the toner replenishing device. In this condition, the toner T delivered from the toner bottle 33 is introduced in the toner replenishing device 40, as stated previously.

To dismount the toner bottle 33 from the toner replenishing device 40, the procedure described above is performed in the reverse order. More specifically, when he toner bottle 33 substantially runs out of toner T, the cover of the copier body 1 is opened to expose the toner replenishing device 40, and then the thumb piece 35*c* of the toner bottle 33, which is held in the set position shown in FIG. 5, is nipped to turn the bottle cap 35 clockwise in FIG. 5.

At this instant, the catch member or second engaging member 43 retains the shutter 36 at the current position on the bottle cap 35, so that the toner outlet 35*b* is closed in accordance with the rotation of the bottle cap 35, as shown in FIG. 4. More specifically, the shutter 36 moves relative to the circumferential surface of the bottle cap 35 to thereby close the toner outlet 35*b*. At this instant, although some toner T may be left in the toner bottle 33, the toner is prevented from being scattered around via the toner outlet 35*b* because the toner outlet 35*b* is sealed by the seal member 37. Thereafter, the toner bottle 33 is pulled upward out of the toner replenishing device 40.

As stated above, in the illustrative embodiment, the toner outlet 35*b* is not open on the circumferential surface of the bottle cap 35, but is open obliquely to the circumferential surface. This, coupled with the fact that the shutter 36 is so configured as to engage with the toner outlet 35*b*, protects the seal member 37 from damage or come-off for thereby insuring the sealing of the toner outlet 35*b* while promoting easy operation of the shutter 37.

In the illustrative embodiment, the spiral ridge 34*a*, formed on the body 34 of the toner bottle 33, discharges the toner from the toner bottle 33 when the body 34 is rotated. Alternatively, an auger, screw or similar conveying member may be disposed in the bottle body 34 and rotated to discharge the toner, in which case the bottle body 34 and bottle cap 35 may be formed integrally with each other because the spiral ridge 34*a* is not necessary.

Further, in the illustrative embodiment, the developing section 20 expected to receive fresh toner from the toner replenishing device is disposed in the process cartridge 4. Alternatively, the developing section may be configured as a single developing unit removably mounted to the copier body 1, in which case fresh toner will be replenished from the toner replenishing device 40 to the developing unit.

Figure 6:
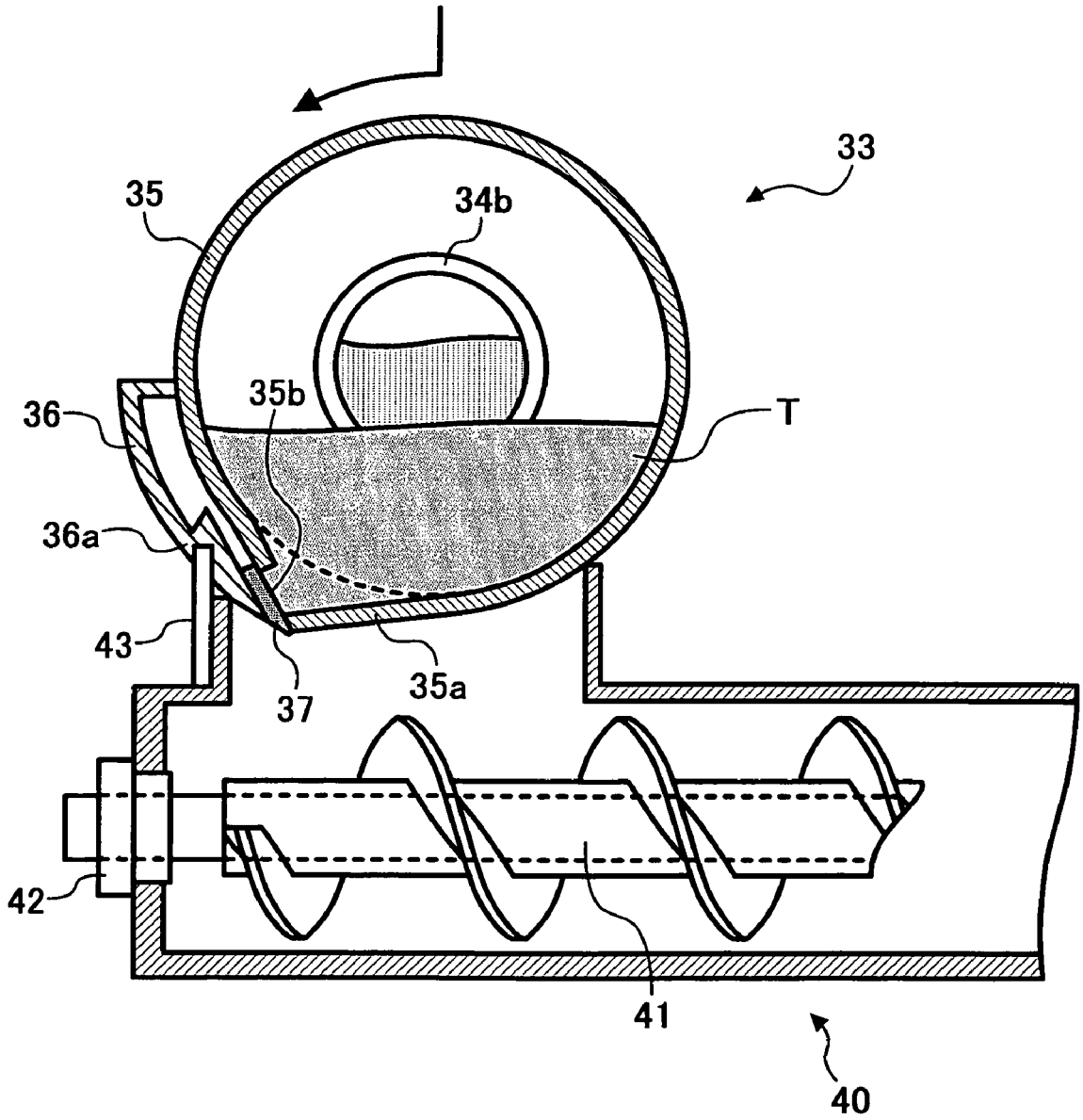
FIG. 6 is a section showing an alternative embodiment of the toner container in accordance with the present invention with a toner outlet being closed.
Figure 7:
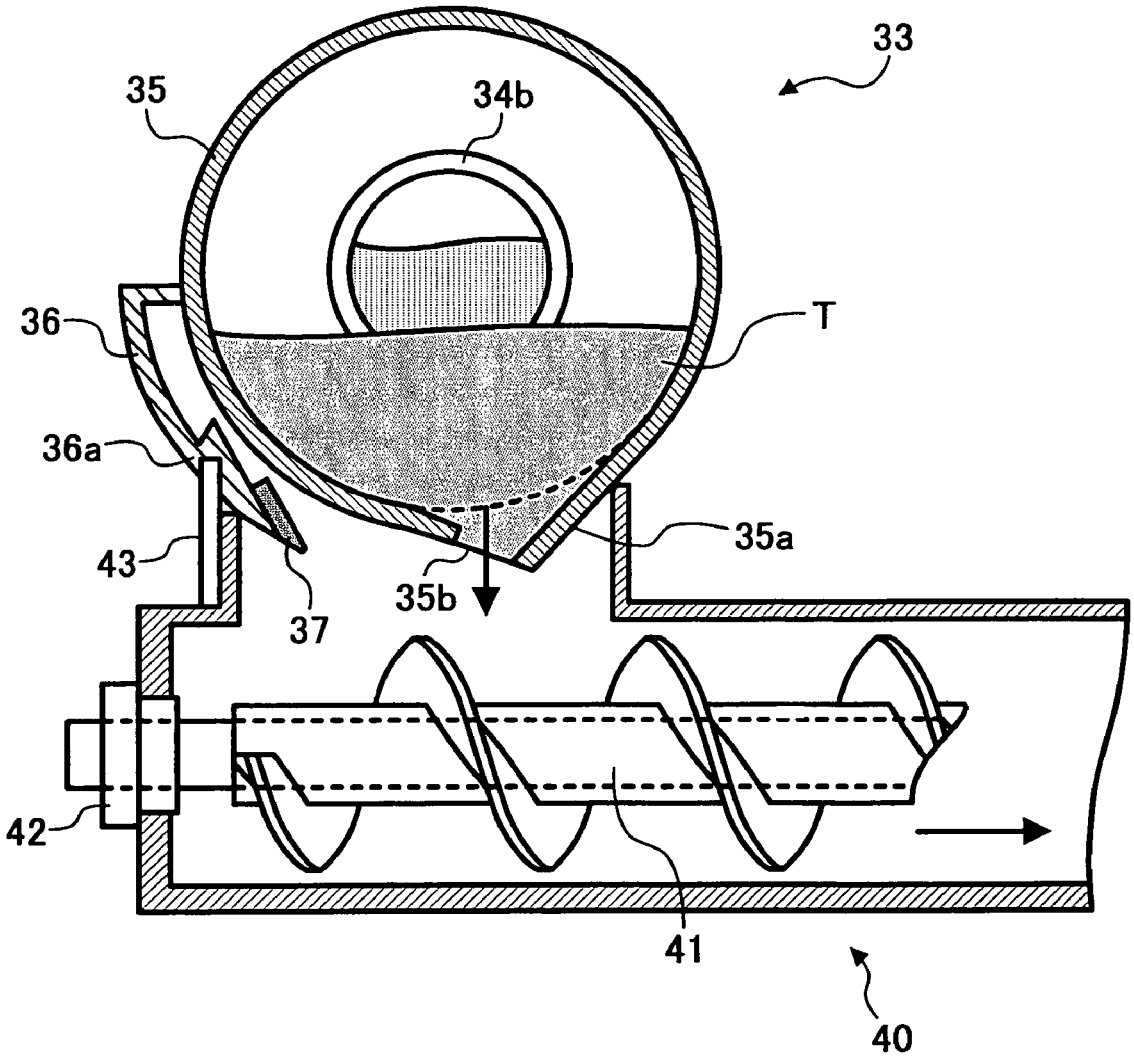
FIG. 7 is a section showing the alternative embodiment with the toner outlet being opened.

An alternative embodiment of the present invention will be described with reference to FIGS. 6 and 7. FIG. 6, corresponding to FIG. 4, shows the toner bottle 33 of the illustrative embodiment with the toner outlet 35*b* being closed. FIG. 7, corresponding to FIG. 5, shows the toner bottle 33 with the toner outlet 35*b* being opened. The illustrative embodiment differs from the previous embodiment mainly in the configuration of the seal member 37 fitted on the shutter 36.

As shown in FIGS. 6 and 7, the toner bottle 33 is generally made up of the bottle body and bottle cap or cylindrical portion 35 as in the previous embodiment. The bottle cap 35 includes the raised portion 35*a*, toner outlet 35*b*, shutter 36 and so forth. The raised portion 35*a* rises on the circumferential surface of the bottle cap 35. The toner outlet 35*b* is formed in the raised portion 35*a* in such a manner as to open obliquely to the circumferential surface of the bottle cap 35.

The shutter 36 is movable along the circumferential surface of the bottle cap 35 as in the previous embodiment. In the illustrative embodiment, the end face or engaging surface of the shutter 36 that faces the toner outlet 35*b* is inclined relative to the circumferential surface of the bottle cap 35 and capable of closing the toner outlet 35*b*. More specifically, the shutter 36 slides back and forth on the circumferential surface of the bottle cap 35 to thereby selectively open or close the toner outlet 35*b*.

The seal member 37 is adhered to the engaging surface of the shutter 36 and may be formed of, e.g., foam polyurethane or rubber. When the toner outlet 35*b* is closed, the seal member 37 intervenes between the shutter 36 and the toner outlet 35*b* and is compressed thereby to prevent the toner from flying about via the toner outlet 35*b*.

In the illustrative embodiment, the seal member 37 is positioned on the shutter 36 such that it does not slide on the circumferential surface of the bottle cap 35 even when the shutter 36 is moved. More specifically, even when the shutter 36 is moved in the circumferential direction, no part of the seal member 3 is rubbed by the periphery of the bottle cap 35.

Further, the direction in which the seal member 37 is compressed, i.e., deformed between the shutter 36 and the toner outlet 35*b* and the direction of movement of the shutter 36 are substantially coincident as in the previous embodiment. The seal member 37 therefore does not slide relative to the toner outlet 35*b* or neighborhood thereof even when the shutter 36 is moved.

Thus, in the illustrative embodiment, when the shutter 36 is moved to open or close the toner outlet 35*b*, the seal member 37 does not contact any member except when it seals the toner outlet 35*b* and neighborhood thereof. In addition, an arrangement is made such that even when he seal member 37 seals the toner outlet 35*b*, the seal member 37 and the neighborhood of the toner outlet 35*b* do not slide on each other. With this configuration, it is possible to surely seal the toner outlet 35*b* and to protect the seal member 37 from damage ascribable to friction while noticeably reducing a load in the event of opening or closing of the toner outlet 35*b*.

As stated above, in the illustrative embodiment, the toner outlet 35*b* is not open on the circumferential surface of the bottle cap 35, but is open obliquely thereto, while the shutter 36 is so configured as to engage with the toner outlet 35*b*. Further, the seal member 37 is not rubbed by any other member even when the shutter 36 is moved for opening or closing the toner outlet 35*b*. The illustrative embodiment therefore protects the seal member 37 from damage or come-off for thereby insuring the sealing of the toner outlet 35*b* and allows the shutter 37 to be easily operated.

In summary, in accordance with the present invention, a toner outlet is open obliquely to the circumferential surface of a cylindrical portion included in a toner container while a shutter is engaged with such a toner outlet. This not only surely seals the toner outlet, but also allows it to be easily opened or closed.

Further, in accordance with the present invention, a seal member for sealing the toner outlet and neighborhood thereof does not slide relative to the toner outlet or neighborhood thereof even when the shutter is moved. It is therefore possible to reduce a load when the toner outlet is opened or closed for thereby protecting the seal member from damage.

Various modifications will become possible for those skilled in the art after receiving the teachings of the present disclosure without departing from the scope thereof.

What is claimed is:

1. A toner container for storing toner, comprising:

a cylindrical portion including a raised portion rising above a circumferential surface of said cylindrical portion, said raised portion being formed with a toner outlet open obliquely to said circumferential surface of said cylindrical portion; and a shutter movable along the circumferential surface of said cylindrical portion to selectively open or close said toner outlet.

2. The toner container as claimed in claim 1, wherein said shutter includes an engaging surface engageable with said toner outlet and so positioned as not to face the circumferential surface of said cylindrical portion.

3. The toner container as claimed in claim 1, wherein said shutter comprises a seal member contacting said toner outlet.

4. The toner container as claimed in claim 3, wherein said seal member is so positioned as not to slide on the circumferential surface of said cylindrical portion when said shutter moves.

5. The toner container as claimed in claim 1, wherein said toner outlet comprises a seal member contacting said shutter.

6. The toner container as claimed in claim 3, wherein a direction in which said seal member is compressed and a direction in which said shutter moves are substantially coincident.

7. The toner container as claimed in claim 1, further comprising a cylindrical, rotatable major portion engaged with said cylindrical portion for conveying the toner toward said cylindrical portion;

said major portion comprising a spiral ridge formed on an inner peripheral surface thereof.

8. The toner container as claimed in claim 1, further comprising a major portion engaged with said cylindrical portion;

said major portion comprising a conveying member disposed therein for conveying the toner toward said cylindrical portion.

9. A toner container for storing toner, comprising:

a cylindrical portion including a raised portion rising above a circumferential surface of said cylindrical surface and formed with a toner outlet; and a shutter movable along the circumferential surface of said cylindrical portion for selectively opening and covering said toner outlet, said shutter comprising a seal member which is positioned on the shutter and is for sealing said toner outlet, said seal member being so positioned as not to slide against said raised portion when said shutter and said seal member move.

10. A toner replenishing device to which a toner container storing toner is removably mounted, said toner container comprising:

a cylindrical portion including a raised portion rising above a circumferential surface of said cylindrical portion, said raised portion being formed with a toner outlet open obliquely to said circumferential surface of said cylindrical portion, said toner outlet configured to discharge toner to said toner replenishing device; and a shutter movable along the circumferential surface of said cylindrical portion to selectively open or close said toner outlet.

11. The device as claimed in claim 10, further comprising an engaging portion engageable with said shutter;

wherein when said cylindrical portion is rotated in a circumferential direction after said toner container has been set, said engaging portion engages with said shutter to thereby open said toner outlet.

12. The device as claimed in claim 11, further comprising a second engaging portion engageable with said shutter, wherein when said cylindrical portion with said toner outlet opened is rotated in a circumferential direction, said second engaging portion engages with said shutter to thereby close said toner outlet.

13. A toner replenishing device to which a toner container storing toner is removably mounted, said toner container comprising:

a cylindrical portion including a raised portion rising above a circumferential surface of said cylindrical surface and formed with a toner outlet;

a shutter movable along the circumferential surface of said cylindrical portion for selectively opening and covering said toner outlet;

said shutter comprising a seal member for sealing said toner outlet;

wherein said shutter is so positioned as not to slide against said raised portion when said shutter and said seal member move.

14. The device as claimed in claim 13, comprising an engaging portion engageable with said shutter;

wherein when said cylindrical portion is rotated in a circumferential direction after said toner container has been set, said engaging portion engages with said shutter to thereby open said toner outlet.

15. The device as claimed in claim 14, further comprising a second engaging portion engageable with said shutter, wherein when said cylindrical portion with said toner outlet opened is rotated in a circumferential direction, said second engaging portion engages with said shutter to thereby close said toner outlet.

16. A developing device for developing a latent image formed on an image carrier with toner to thereby produce a corresponding toner image, said developing device comprising:

a toner replenishing device to which a toner container storing the toner is removably mounted;

said toner container comprising:

a cylindrical portion including a raised portion rising above a circumferential surface of said cylindrical portion, said raised portion being formed with a toner outlet open obliquely to said circumferential surface of said cylindrical portion; and a shutter movable along the circumferential surface of said cylindrical portion to selectively open or close said toner outlet;

said toner replenishing device receiving the toner discharged from said toner outlet.

17. A developing device for developing a latent image formed on an image carrier with toner to thereby produce a corresponding toner image, said developing device comprising:

a toner replenishing device to which a toner container storing the toner is removably mounted;

said toner container, comprising:

a cylindrical portion including a raised portion rising above a circumferential surface of said cylindrical surface and formed with a toner outlet;

a shutter movable along the circumferential surface of said cylindrical portion for selectively opening and covering said toner outlet;

said shutter comprising a seal member for sealing said toner outlet;

wherein said shutter is so positioned as not to slide against said raised portion when said shutter and said seal member move.

18. A process cartridge for use in an image forming apparatus, said process cartridge comprising:

a developing device for developing a latent image formed on an image carrier with toner to thereby produce a corresponding toner image, said developing device comprising:

a toner replenishing device to which a toner container storing the toner is removably mounted;

said toner container comprising:

a cylindrical portion including a raised portion rising above a circumferential surface of said cylindrical portion, said raised portion being formed with a toner outlet open obliquely to said circumferential surface of said cylindrical portion; and a shutter movable along the circumferential surface of said cylindrical portion to selectively open or close said toner outlet;

said toner replenishing device configured to receive the toner discharged from said toner outlet.

19. A developing device for developing a latent image formed on an image carrier with toner to thereby produce a corresponding toner image, said developing device comprising:

a toner replenishing device to which a toner container storing the toner is removably mounted;

said toner container comprising:

a cylindrical portion including a raised portion rising above a circumferential surface of said cylindrical portion, said raised portion being formed with a toner outlet open obliquely to said circumferential surface of said cylindrical portion; and a shutter movable along the circumferential surface of said cylindrical portion to selectively open or close said toner outlet;

said toner replenishing device configured to receive the toner discharged from said toner outlet.

20. A process cartridge for use in a body of an image forming apparatus, said process cartridge comprising:

developing device for developing a latent image formed on an image carrier with toner to thereby produce a corresponding toner image, said developing device comprising:

a toner replenishing device to which a toner container storing the toner is removably mounted;

said toner container, comprising:

a cylindrical portion including a raised portion rising above a circumferential surface of said cylindrical surface and formed with a toner outlet;

a shutter movable along the circumferential surface of said cylindrical portion for selectively opening and covering said toner outlet;

said shutter comprising a seal member for sealing said toner outlet;

wherein said shutter is so positioned as not to slide against said raised portion when said shutter and said seal member move.

21. A process cartridge for use in an image forming apparatus, said process cartridge comprising:

a developing device for developing a latent image formed on an image carrier with toner to thereby produce a corresponding toner image, said developing device comprising:

a toner replenishing device to which a toner container storing the toner is removably mounted;

said toner container comprising:

a cylindrical portion including a raised portion rising above a circumferential surface of said cylindrical portion, said raised portion being formed with a toner outlet open obliquely to said circumferential surface of said cylindrical portion; and a shutter movable along the circumferential surface of said cylindrical portion to selectively open or close said toner outlet;

said toner replenishing device receiving the toner discharged from said toner outlet.

22. An image forming apparatus comprising:

a toner replenishing device to which a toner container storing toner is removably mounted, said toner container comprising:

a cylindrical portion including a raised portion rising above a circumferential surface of said cylindrical portion, said raised portion being formed with a toner outlet open obliquely to said circumferential surface of said cylindrical portion; and a shutter movable along the circumferential surface of said cylindrical portion to selectively open or close said toner outlet;

said toner replenishing device receiving the toner discharged from said toner outlet.

* * * * *